US009873206B2

(12) United States Patent
Gulledge

(10) Patent No.: US 9,873,206 B2
(45) Date of Patent: Jan. 23, 2018

(54) INTERCHANGEABLE SHAVER

(71) Applicant: Karl O. Gulledge, Laguna Beach, CA (US)

(72) Inventor: Karl O. Gulledge, Laguna Beach, CA (US)

( * ) Notice: Subject to any disclaimer, the term of this patent is extended or adjusted under 35 U.S.C. 154(b) by 0 days.

(21) Appl. No.: 14/210,150

(22) Filed: Mar. 13, 2014

(65) Prior Publication Data

US 2016/0136827 A1 May 19, 2016

(51) Int. Cl.
*B26B 21/52* (2006.01)

(52) U.S. Cl.
CPC ..... *B26B 21/523* (2013.01); *B26B 21/521* (2013.01)

(58) Field of Classification Search
CPC ..... B26B 21/523; B26B 21/521; B26B 21/52
USPC ..... 30/526, 537, 527, 531, 32; 15/143.1, 15/144.1–144.4; 16/111.1, 110.1, 426, 16/427
See application file for complete search history.

(56) References Cited

U.S. PATENT DOCUMENTS 2,349,252 A * 5/1944 Douglass ..... B26B 21/00 30/122
3,363,312 A * 1/1968 Fayed ..... B26B 21/26 30/40.1
3,894,807 A * 7/1975 Betz ..... B05C 17/0205 15/145
4,392,303 A * 7/1983 Ciaffone ..... B26B 21/521 30/526
4,905,372 A * 3/1990 Willis ..... B26B 21/523 30/526
4,970,784 A 11/1990 Althaus et al.
5,167,069 A * 12/1992 Quinn ..... B26B 21/523 30/527
5,810,027 A 9/1998 Frantzekakis
5,911,480 A * 6/1999 Morgan ..... B26B 21/523 30/125
6,189,222 B1 2/2001 Doyle
6,266,888 B1 7/2001 Zowaski
D472,673 S 4/2003 Carvotta
6,880,253 B1 4/2005 Gyllerstrom
7,100,284 B2 9/2006 King
7,526,869 B2 5/2009 Blatter et al.
D605,362 S 12/2009 Andersen
7,669,511 B2 3/2010 King
7,856,725 B2 12/2010 Marut
D664,297 S 7/2012 Prat-Pfister
(Continued)

*Primary Examiner* — Phong Nguyen
(74) *Attorney, Agent, or Firm* — Kirk A. Buhler; Buhler & Associates

(57) ABSTRACT

Improvements in an interchangeable shaver that accepts a variety of different disposable razors. To retain a disposable razor with a handle the interchangeable shaver has a cavity where the handle of the disposable razor slides into the holder to grip the handle and prevents the disposable razor from rotating as the shaver is drawn up, down and along the back, legs or other area of a person. The adapter angles the disposable razor to provide an optimal shaving angle for maximum hair removal and the closest shave to reduce the frequency of repeat shaving. A further improvement is an adapter that connects the interchangeable shaver to a disposable head. The adapter is configured to accommodate different disposable heads with a single adapter. The shaver has an extendable handle configured to prevent the razor from rotating on the shaft.

9 Claims, 6 Drawing Sheets

(56) References Cited

U.S. PATENT DOCUMENTS

| | | | | |
|---|---|---|---|---|
| D678,610 | S | 3/2013 | Prat-Pfister | |
| 2003/0177648 | A1* | 9/2003 | Zeiter | B26B 21/523 30/526 |
| 2004/0107585 | A1* | 6/2004 | Helmrich | B26B 19/38 30/537 |
| 2009/0100679 | A1* | 4/2009 | Casciaro | B26B 21/165 30/34.05 |
| 2010/0283017 | A1* | 11/2010 | Darbinyan | B66F 15/00 254/129 |

* cited by examiner

INTERCHANGEABLE SHAVER

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a shaver for self-shaving a person's own back, legs or other area that might be difficult to reach. More particularly, the present back shaver provides an adjustable extension arm that allows a person to connect a disposable razor that can be purchased from a store and temporally secured to the adjustable extension arm to allow a person to self-shave their back legs or other area that might be difficult to reach.

Description of Related Art Including Information Disclosed Under 37 CFR 1.97 and 1.98

As people get older, especially men, hair begins to grow on the back of a person. For some the hair can grow thick and may cause trouble with clothing and may be unsightly and undesirable. Removal of the hair can take a number of different methods. One method can be to have another person remove the hair on their back using a razor, wax, laser, chemicals or electrolysis. These methods require a second person to remove the hair from a back legs or other area that might be difficult to reach. This problem can also occur in pregnancy or for a person who in handicapped and wants to shave an area that may be out of their normal reach.

For a person to shave the hair on one's own back requires a mechanism that allows access to the complete back to be shaved. To shave the hair to a minimal length of hair or a "close shave" the optimal angle of the shaving blade to the skin must be maintained over the entire surface of the back. The causes particular difficulty because the shape, length and width of a back, the use of one or both arms and the contours of a back around the sides, shoulder blades, the spine and the planar/contoured sections of a back.

A number of patents and or publications have been made to address these issues. Exemplary examples of patents and or publication that try to address this/these problem(s) are identified and discussed below.

U.S. Pat. No. 5,167,069 issued on Dec. 1, 1992 to Kathleen H. Quinn discloses an invention called the Razor Reach. The razor in this patent has a linear extending straight handle with a pivoting razor at the end of the handle. The razor is pivoted in fixed increments to allow a person to set the length of the arm, adjust the angle and then reach the razor behind their back to shave the hair. While this patent allows a person to shave their own back or other area that is difficult to reach, the razor is a custom razor and does not accept standard pre-existing razors or replacement heads.

U.S. Pat. No. 6,266,888 issued on Jul. 31, 2001 for Thomas E. Zowaski discloses a Reaching Razor. This patent has an adjustable handle with pivoting elbow sections. While the razor allows a person to reach behind them to shave a back, the pivoting elbows must be frequently readjusted to accommodate the contours of a back as the user shaves the power back, the upper back and around their sides.

U.S. Pat. No. 7,856,725 issued on Dec. 28, 2010 for Brett C. Marut discloses a Razor With Articulated Handle Extension. This paten has a handle that essentially folds in-half to shorten the handle to achieve a long reach and also to make a more compact size for storage. The patent further uses an electric razor to shave back hair without using disposable razors. While this patent provides a razor that can be used to shave a back, the razor does not use replaceable razors and razor heads.

What is needed is an extendable razor that is easily extendable to set the angle of the shaving blade at the optimal angle for hair removal. The shaver should also accept disposable razor and razor heads. This disclosure provides a solution to the problem that has not been solved by others.

BRIEF SUMMARY OF THE INVENTION

It is an object of the interchangeable shaver to accept a variety of different disposable razors. Disposable razors are made by a variety of different companies and each company has their own geometry for the head and for the shaft or handle that retains the razor blades. These disposable razors can have from one to a multiple number of razors. To retain a disposable razor with a handle the interchangeable shaver has a cavity where the handle of the disposable razor slides into the holder to grip the handle and prevents the disposable razor from rotating as the shaver is drawn up, down and along the back, legs or other area of a person. While the handle retainer firmly grasps the handle the holder also allows quick release of the disposable razor. The adapter angles the disposable razor to provide an optimal shaving angle for maximum hair removal and the closest shave to reduce the frequency of repeat shaving.

It is an object of the interchangeable shaver to have an adaptor for accepting a replaceable shaving head. While some disposable razors provide a complete razor, it is often more common to replace just the head with blades. For this type of replaceable blades the interchangeable shaver has an adapter that connects the interchangeable shaver to a disposable head. The adapter is configured to accommodate different disposable heads with a single adapter.

It is another object of the interchangeable shaver for the shaft to be extendable. Making the shaft extendable allows the user to work with a short handle, a long handle or any intermediate length to have maximum versatility with a length of between six inches and 36 inches. The extendable shaft further allows a user to reduce the overall length for storage and transportation as well as extend the shaft to a desired length for use. Extension of the handle is provided with fixed detents or with friction couplings.

It is still another object of the interchangeable shaver to have a non-round shaft. The non-round shaft is used to prevent the razor head from rotating as the razor is being dragged along the back, legs or other area of the body. The shaft can be elliptical, multi-sided or have a key that prevents rotation of the telescoping sections.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
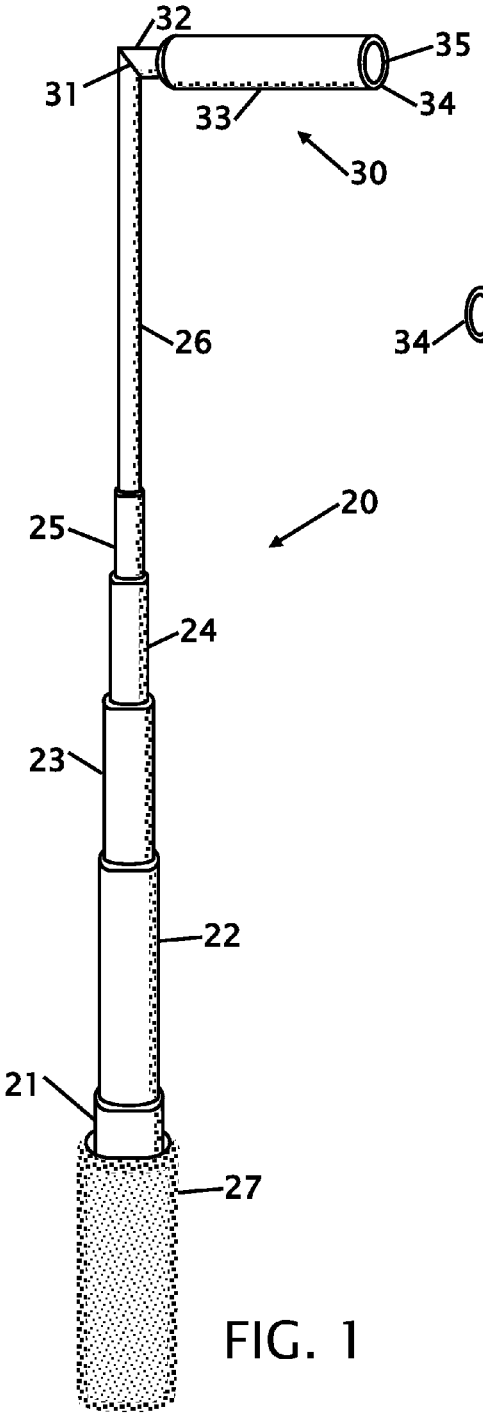
FIG. 1 shows a side view of the telescoping hand tool extended.
Figure 2:
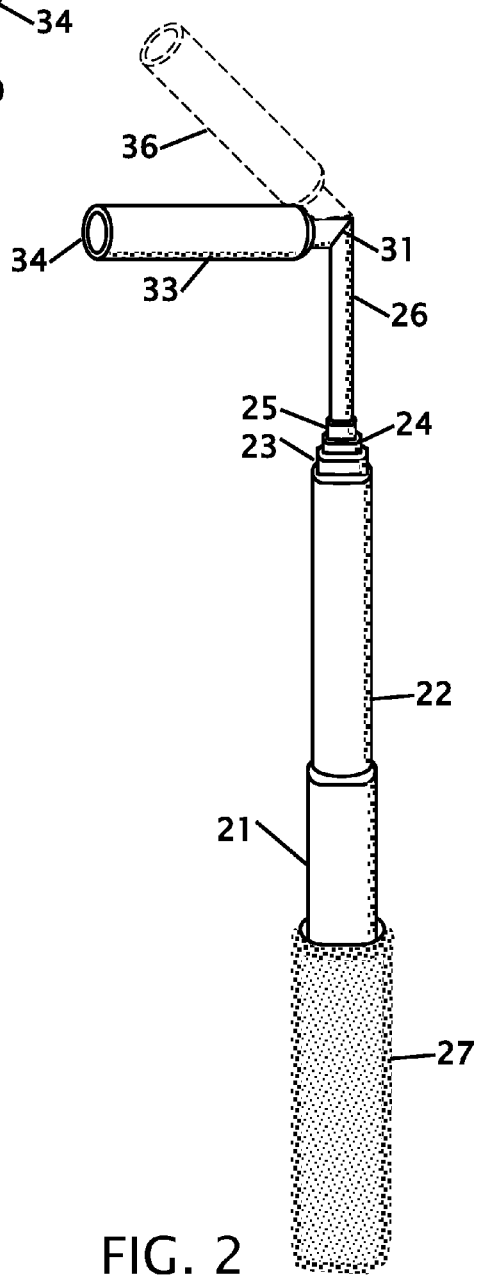
FIG. 2 shows a side view of the telescoping hand tool retracted.
Figure 3:
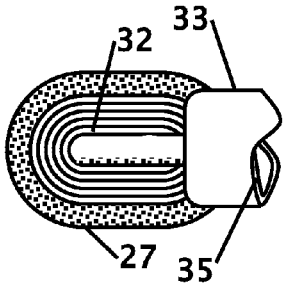
FIG. 3 shows a top view of the telescoping hand tool.

FIG. 1 shows a side view of the telescoping hand tool 20 extended, FIG. 2 shows a side view of the telescoping hand tool 20 retracted and FIG. 3 shows a top view of the telescoping hand tool 20. From FIG. 1 the hand tool 200 is shown at near complete extension. The sections are configured as non-circular sections to prevent the sections from spinning within each other. This ensures that when a person is placing torsional loads on a shaver the head of the razor will not rotate to an undesirable orientation. In the preferred embodiment the shaft sections are elliptical or flattened circular sections of telescoping sizes. From the largest section 21 to the smallest section 26. While six sections hand section, 22, 23, 24, 25 and top section 26 are shown, there could be more or less than six sections.

The number of sections are selected based upon the desired length of that is desired by the user. The hand section 21 is shown with a cushion 27 that also makes the hand tool 20 easier to grasp if the users' hand is wet. The top view of FIG. 3 shows the elliptical shape of the sections. The last section 26 of the arm has an elbow 31 transitions into a cross section 32 that angles the cross section 32 from the pole sections 21-26. The cross section 32 has a receiver 30. The receiver is essentially a cylindrical receiving tube 33 with an interior hole 35. The end of the rim 34 provides a shoulder.

In FIG. 2 the sections 21-26 are shown shortened to allow a user to access an area of the back that is closer to the handle. The sections are tightly telescoped together to reduce movement between adjoining sections. It is also contemplated that the sections can have detents or spring loaded pins that retain sections in fixed positions. When using spring loaded pins the pins must be depressed to allow the section(s) to slide or telescope with each other. Making the shaft extendable allows the user to work with a short handle, a long handle or any intermediate length to have maximum versatility with a length of between six inches and 36 inches. The extendable shaft further allows a user to reduce the overall length for storage and transportation as well as extend the shaft to a desired length for use. Extension of the handle is provided with fixed detents or with friction couplings.

FIG. 2 further shows the receiver 30 placed at an angle 36 to allow the receiver to provide a different angle 36 for the receiver hole 34. It is contemplated that the elbow 31 can allow the cross section to pivot on the last section 26 to alter the angle from 90 degree to straight.

Figure 4:
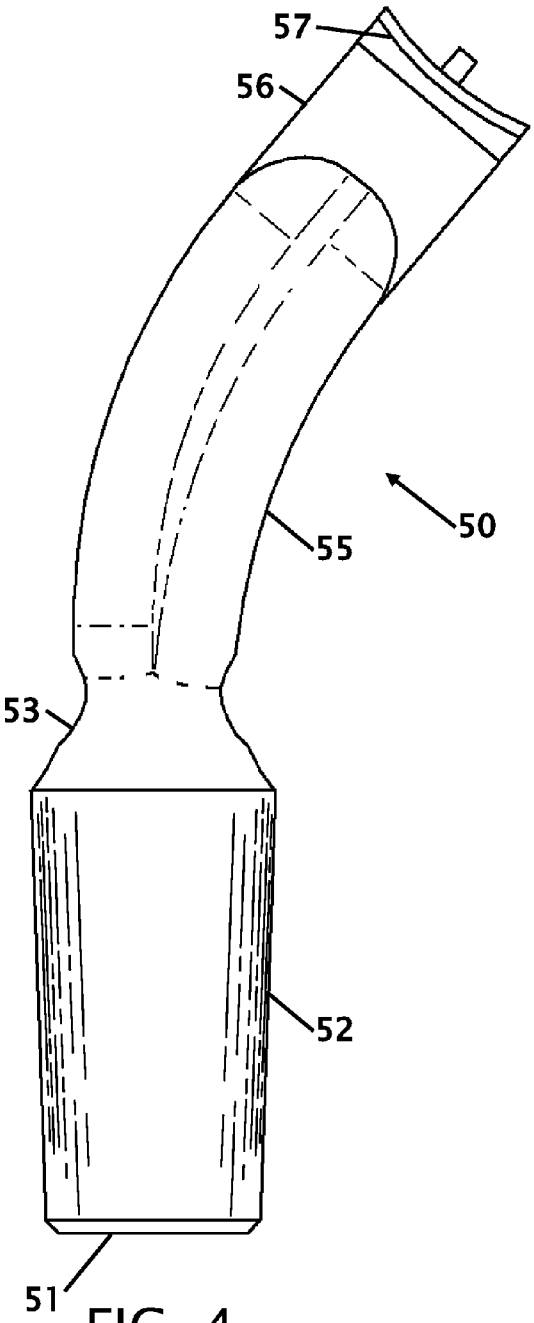
FIG. 4 shows a side view of the shaver.
Figure 5:
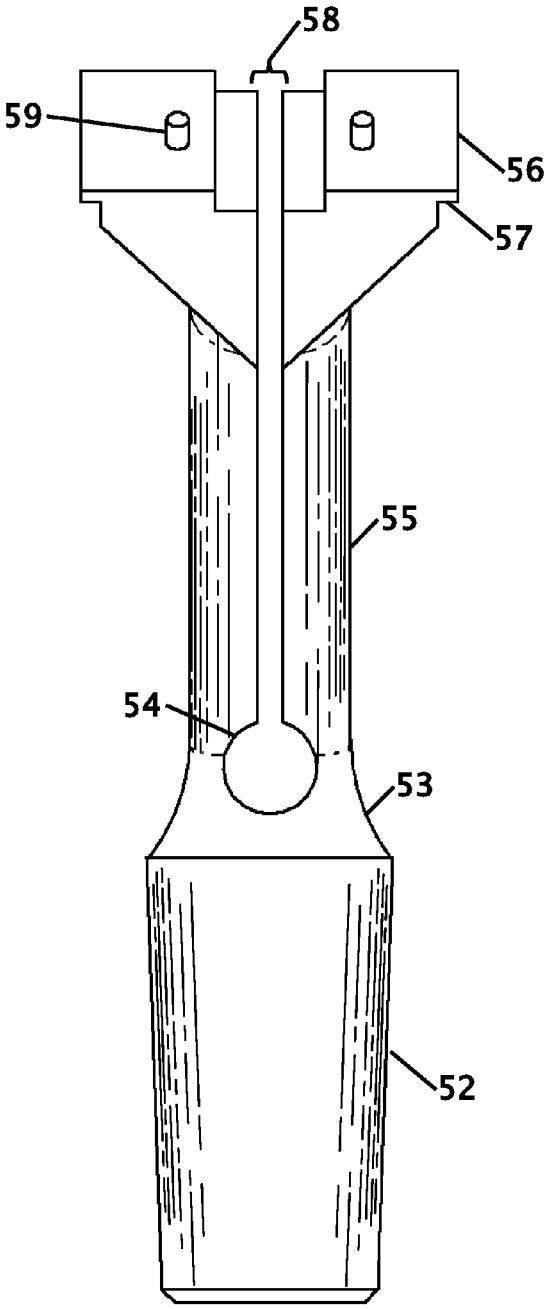
FIG. 5 shows a front view of the shaver.
Figure 6:
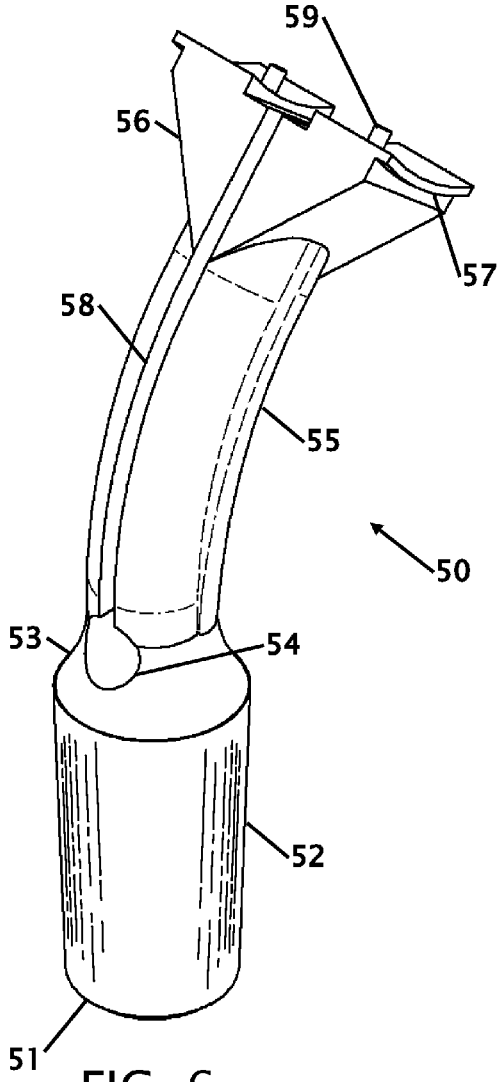
FIG. 6 shows a rear top perspective view of the shaver.
Figure 7:
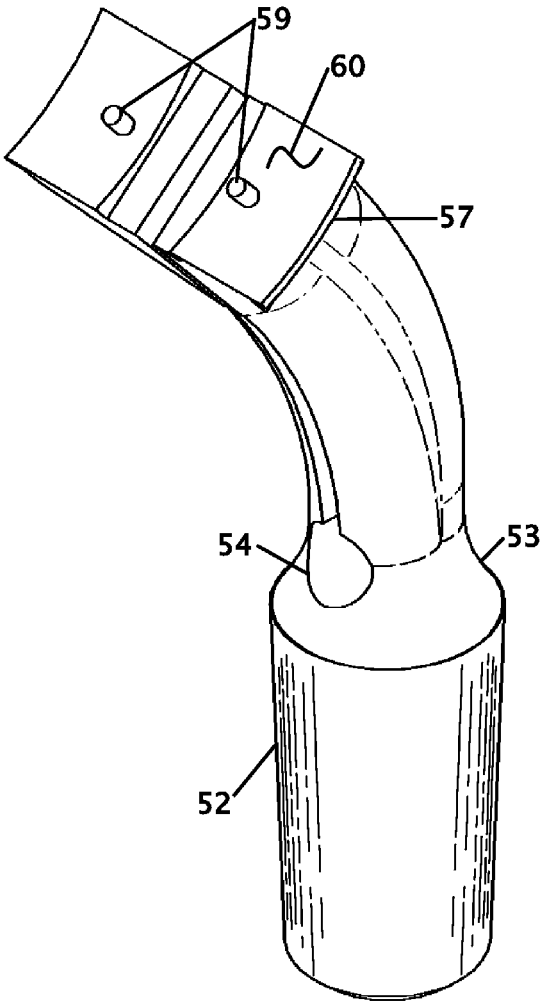
FIG. 7 shows a front top perspective view of the shaver.

FIG. 4 shows a side view of the shaver, FIG. 5 shows a front view of the shaver 50, FIG. 6 shows a rear top perspective view of the shaver 50 and FIG. 7 shows a front top perspective view of the shaver 50. The shaver 50 has a bottom surface 51 with a chamfer that allows the shaver 50 to be inserted into the receiver hole 35 (shown in FIG. 1) of the receiver 30. A taper 52 allows the shaver 50 to be gripped within the receiver hole 35. Both the taper 52 of the shaver 50 and a taper in the receiver hole 35 are approximately the same to provide sufficient gripping forces without the use on fasteners or bonding agents. The mid-section of the shaver 50 is a curved neck 55. The curved neck 55 provides a preferred angle of about 40 degrees to create a more optimal angle for shaving. The curved neck 55 extends to an expansion 56.

The expansion spreads the shaver 50 to provide a locating and gripping portion for securing a replaceable razor head (not shown). The top of the shaver 50 has a curved surface that allows a replaceable razor to move in an arc travel 57 on the shaver 50 and on the curved face 60. A plurality of locating and stop pins 59 is located on the end of the shaver 50 to limit the arc travel of a replaceable razor head.

The shaver 50 has a split 58 that extends down to a through hole 54 near a relief 53 near the taper 52. This split 58 allows the two sides of the shaver 50 to be flexed together to accept a disposable razor head and to return to a normal position to retain the disposable razor head. The shape and configuration of the pins and arc travel 57 allows different disposable razor heads from different manufactures to mount onto the shaver 50 thereby allowing the shaver 50 to provide a universal solution for disposable razors.

Figure 8:
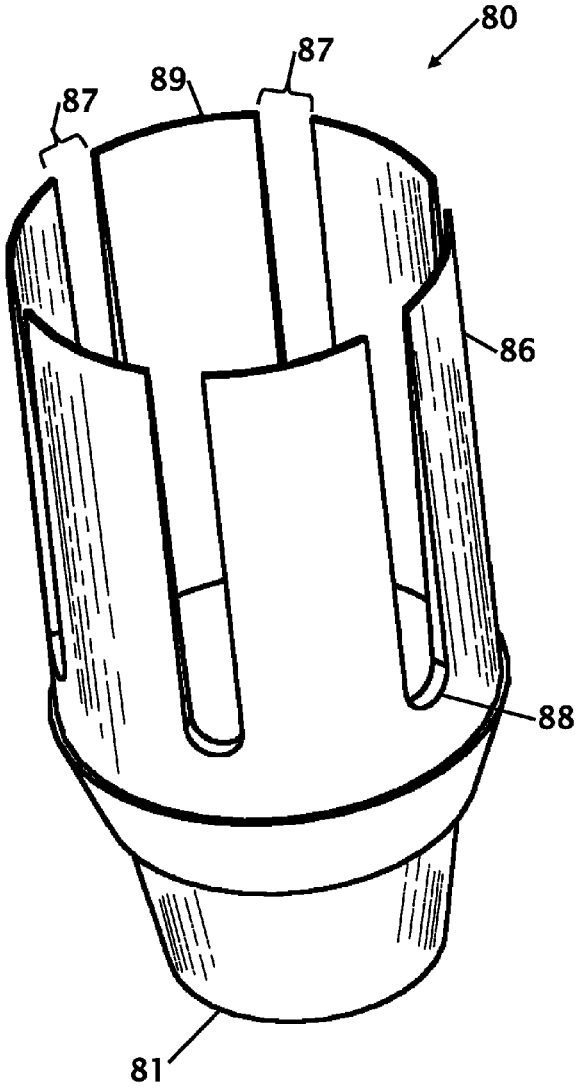
FIG. 8 shows top front perspective view of the insert.
Figure 9:
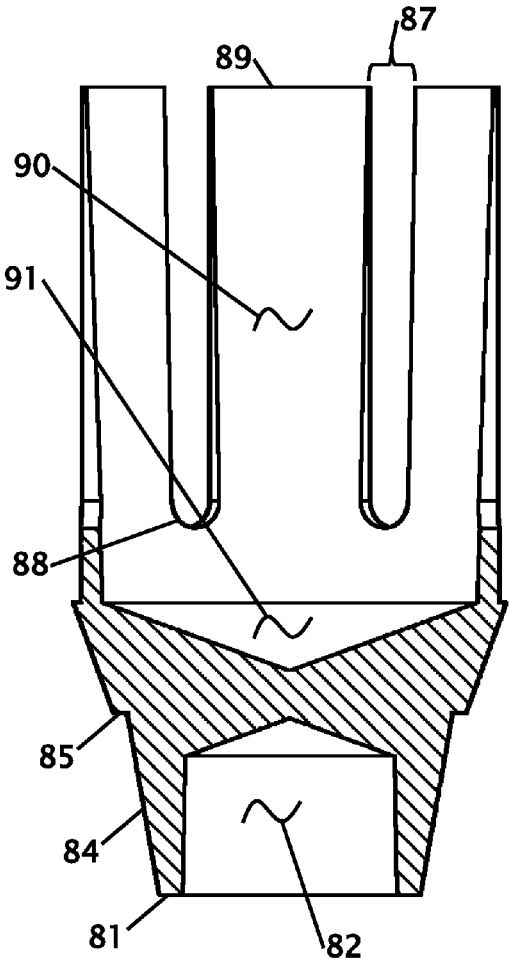
FIG. 9 shows a side sectional view of the insert.

FIG. 8 shows top front perspective view of the insert 80, FIG. 9 shows a side sectional view of the insert 80. The insert 80 has a bottom end 81 with a relief hole 82 that provides a reduced weight to the insert 80. From the base 81 the side is tapered 84 to allow the insert 80 to be inserted and gripped by the inside tapered diameter of the receiver 30 (shown in FIG. 1) without the use of a fastener or bonding. A shoulder 85 prevents the insert 80 from being inserted too far into the receiver 30. The body of the insert 80 then expands to a plurality of spring tabs 86.

Figure 11:
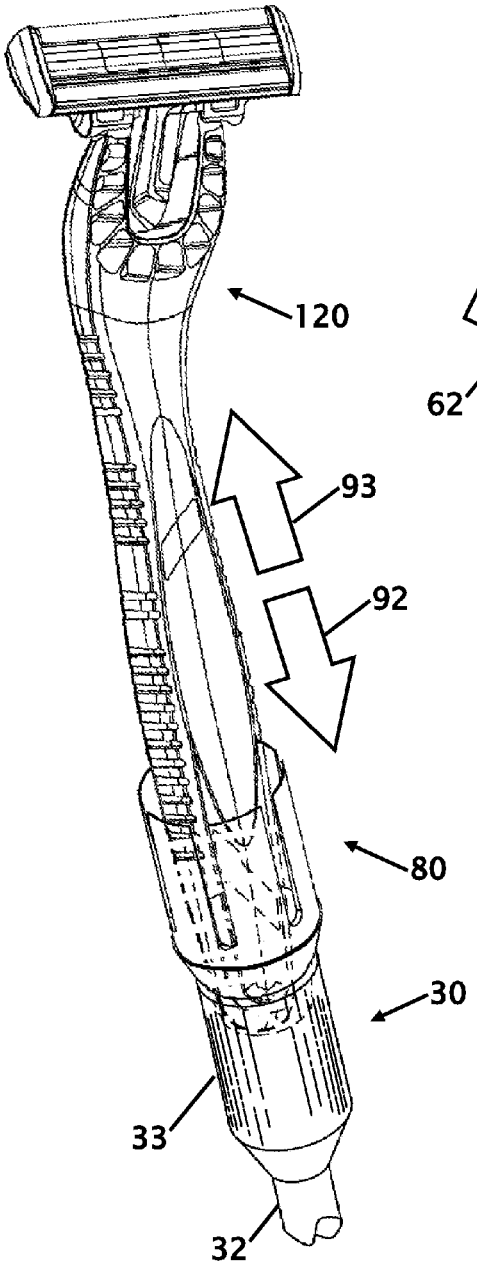
FIG. 11 shows a perspective view of a razor inserted into the insert and then into the hand tool.

In this preferred embodiment of the insert 80 there are six spring tabs 86, but more or less than six spring tabs 86 are contemplated. The selection of six spring tabs 86 has provided the optimal number for grasping onto the handle of a disposable shaver 120 (as shown in FIG. 11). The spring tabs 86 are relieved with slots 87 that extend to a slot relied 88 hole that essentially allows each spring tab 86 to operate independently from the base of the insert 80 to the end 89 of each spring tab 86. The inside 90 surface of the spring tab(s) 86 are curved to press against the handle of a disposable razor 120. The inside bottom of the insert 80 has receiver pocket 91 where the end of a disposable razor 120 stops or rests.

Figure 10:
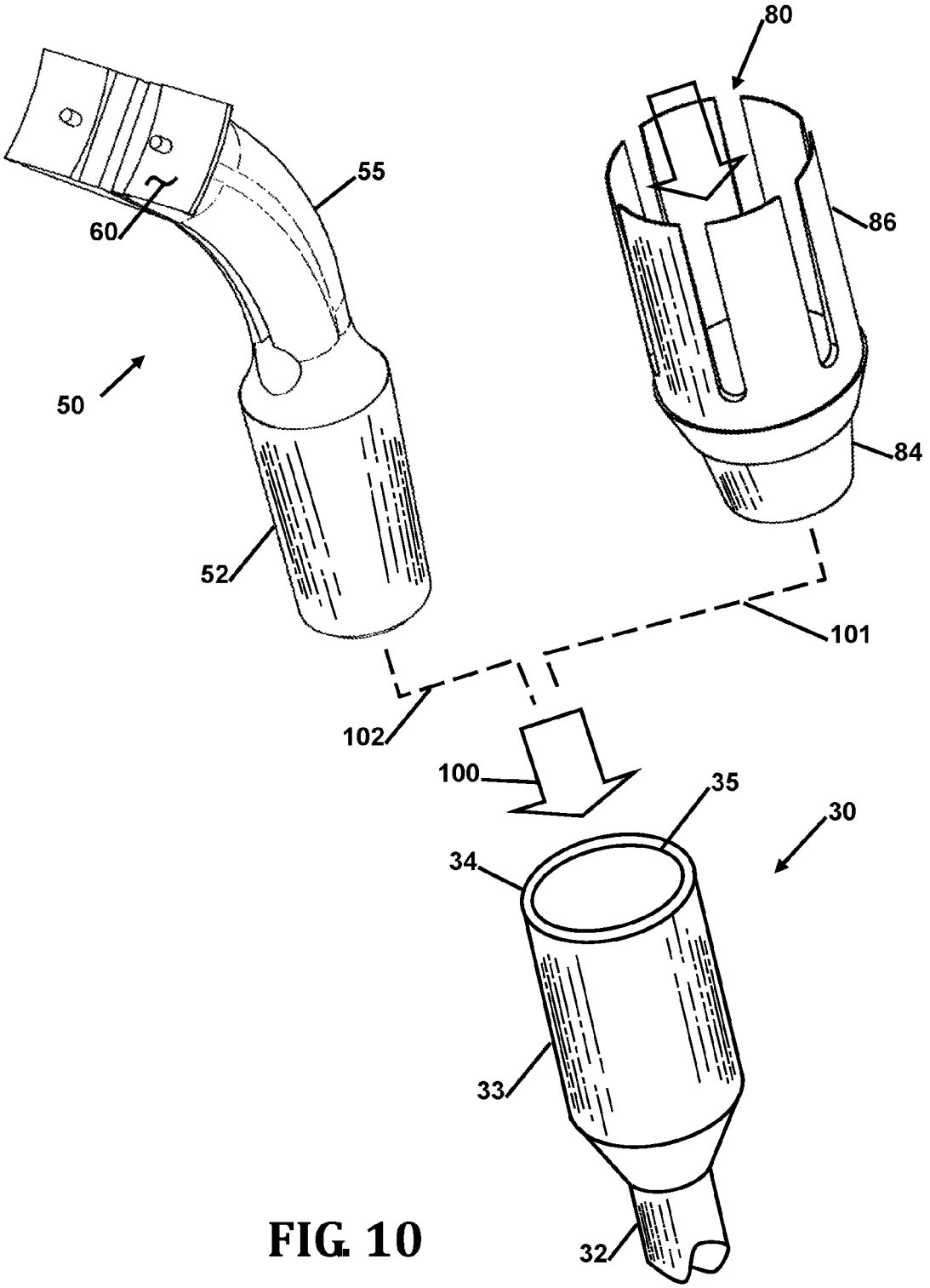
FIG. 10 shows a perspective view of the shaver and the insert for the end of the hand tool.

FIG. 10 shows a perspective view of the shaver 50 and the insert 80 for the end of the hand tool 35. From the bottom of this figure the open end 35 of the receiver 30 is shown at the end of the cross member 32 of the receiver tube 33. The neck 55 extends to the curved face of the shaver 50. With the insert 80 the spring tabs 86 extend from the tapered end 84. The tapered end 52 of the shaver 50 and the tapered end 84 of the insert 80 are essentially the same and compliment the hole 35 of the receiver 30.

The shaver 50 can be inserted 102 into the receiver hole 35 of the receiver. The insert 80 can also be inserted 101 or interchanged into 100 the open end 34 of the receiver hole 35 to accept a disposable razor secured into the insert 80 or disposable shaving head secured to the shaver 50.

FIG. 11 shows a perspective view of a disposable razor 120 inserted into the insert 80 and then into the hand tool 30. This is a typical configuration when using a disposable razor with an attached handle 120. A user inserts 92 the disposable razor 120 into the insert 80, and the insert 80 into the receiver tube 33 of the receiver 30 until the end of the handle of the disposable razor 120 is gripped. The user may rotate the disposable razor 120 to obtain optimal grip of the handle of the disposable razor and the irregular shaft of the disposable razor 120 falls into the slots of the spring tabs of the insert 30. The cross member 32 extends to the adjustable shaft of the receiver 30 to allow the user to set the desired length of the handle. After the disposable razor 120 has been sufficiently used, a user simply pulls 93 the disposable razor out of the insert 80 and can then install a replacement disposable razor 120 into the insert 80.

Figure 12:
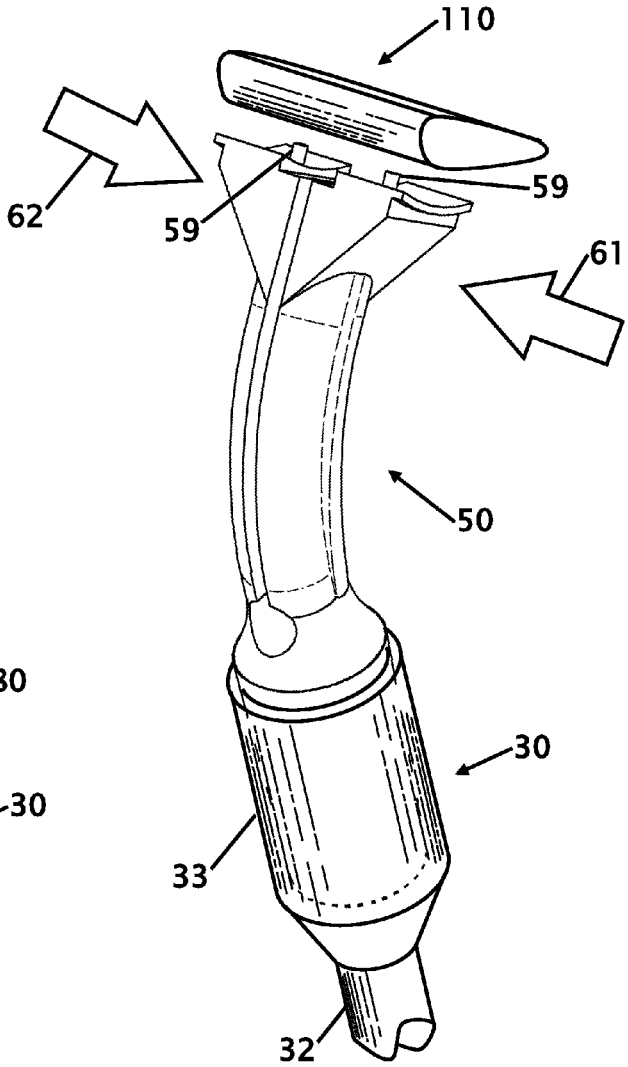
FIG. 12 shows a perspective view of a disposable razor head on the shaver and then into the hand tool.

FIG. 12 shows a perspective view of a disposable razor head 110 on the shaver 50 and then into the hand tool 30. This is a typical configuration when using a disposable razor head 110. A user inserts the shaver 50 into the receiver tube 33 of the receiver 30 and the squeezes 61/62 the sides of the shaver 50 as they place a disposable razor head 110 onto the shaver 50 to grip the disposable razor head 110. The cross member 32 extends to the adjustable shaft of the receiver 30 to allow the user to set the desired length of the handle. After the disposable razor head 110 has been sufficiently used, a user simply squeezes 61/62 the sides of the shaver 50 to release the disposable razor head 110. The user can then install a replacement disposable razor 110 into the insert shaver 50.

Thus, specific embodiments of an interchangeable shaver have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An interchangeable shaver comprising:

a handle;

said handle being extendable;

said handle having multiple sections that telescope together;

said handle having an interior hole for accepting at least one adapter;

said at least one adapter configured to accept a disposable razor head;

said at least one adapter having two spring tabs grip an inside of said disposable razor head;

said interior hole is tapered to accept a complimentary tapered shaft to retain said at least one adapter in said handle, and said at least one adapter has a split curved neck having said two spring tabs that extend between said tapered shaft to a hole and said two spring plurality of tabs for accepting said disposable razor head whereby said split curved neck is configured to flex and move said two spring tabs closer together to accept said disposable razor head.

2. The interchangeable shaver according to claim 1 wherein said spring tabs includes outward facing opposing engagement features that grasp said disposable razor head and a curved surface that allows said disposable razor head to move in an arc travel on said adapter.

3. The interchangeable shaver according to claim 1 wherein said tapered circular shaft is a male and said circular hole is a female that engage into each other to provide a grip of said tapered shaft in said hole.

4. The interchangeable shaver according to claim 1 wherein said multiple telescoping sections are not round in cross section.

5. The interchangeable shaver according to claim 1 wherein said multiple telescoping sections are elliptical in cross section.

6. The interchangeable shaver according to claim 1 wherein said multiple telescoping sections provide adjustment between six inches and 36 inches.

7. The interchangeable shaver according to claim 1 wherein said adapter further includes a receiver that is angularly adjustable relative to said handle with an elbow having angled cross sections.

8. The interchangeable shaver according to claim 1 wherein said at least one adapter has a curved arc.

9. The interchangeable shaver according to claim 8 wherein said at least one pin stop limits travel of said disposable razor on said curved arc.

* * * * *